United States Patent [19]

Brackman

[11] 4,446,876

[45] May 8, 1984

[54] TOBACCO METERING AND FEEDING SYSTEM

[75] Inventor: Warren A. Brackman, Cocksville, Canada

[73] Assignee: Rothmans of Pall Mall Canada Limited, Don Mills, Canada

[21] Appl. No.: 493,168

[22] Filed: Jun. 15, 1983

Related U.S. Application Data

[62] Division of Ser. No. 168,505, Jul. 14, 1980.

[30] Foreign Application Priority Data

Jul. 10, 1979 [GB] United Kingdom ..... 7923990

[51] Int. Cl.[3] ..... A24B 3/06

[52] U.S. Cl. ..... 131/110; 131/109 R; 131/109 B

[58] Field of Search ..... 131/109 B, 109 R, 110, 131/108, 84 B, 84 R; 406/62, 16; 34/46

[56] References Cited

U.S. PATENT DOCUMENTS

| | | | |
|---|---|---|---|
| 3,362,414 | 1/1968 | Wochnowski | 131/110 |
| 3,386,773 | 6/1968 | Ballard, Jr. | 406/16 |
| 3,409,025 | 11/1968 | Wochnowski | 34/46 |
| 3,450,311 | 6/1969 | Bonneric | 131/108 |
| 4,135,615 | 1/1979 | Brackmann et al. | 131/108 |
| 4,223,685 | 9/1980 | Labbe | 131/109 R |

FOREIGN PATENT DOCUMENTS

| | | | |
|---|---|---|---|
| 1285929 | 12/1968 | Fed. Rep. of Germany | 131/110 |

*Primary Examiner*—V. Millin
*Assistant Examiner*—H. Macey
*Attorney, Agent, or Firm*—Sim & McBurney

[57] ABSTRACT

A tobacco metering, conveying and separating system (10) is provided for feeding cut tobacco from a source thereof (12) to a cigarette-making machine at a substantially lower rate, with consequential decrease in tobacco degradation than in conventional systems. A continuous air flow is used in the conveyor pipe (32) and a rotary air lock (50) is used to discharge tobacco from the tobacco-air separator (34).

6 Claims, 2 Drawing Figures

TOBACCO METERING AND FEEDING SYSTEM

REFERENCE TO RELATED APPLICATION

This application is a division of application Ser. No. 168,505 filed July 14, 1980.

FIELD OF INVENTION

The present invention relates to the metering and feeding of tobacco from a source of cut tobacco to a cigarette-making machine.

BACKGROUND TO THE INVENTION

Tobacco is conventionally fed from a source of cut tobacco to a cigarette-making machine by air conveying through a feed pipe at high speed, typically about 4000 ft/min (about 1300 m/min). The tobacco is air conveyed through the feed pipe to an air-lock separator wherein tobacco is separated from the conveying air and is accumulated therein as a stationary mass until a desired amount has been collected. The vacuum is shut off and the air lock opened to dump the stationary mass into the cigarette-making machine hopper.

Air conveying of tobacco at the high speeds required for reliable operation of this prior art system leads to degradation of the particle size of the tobacco and any degradation in particle size leads to loss of filling power of the tobacco, that is, the ability of the tobacco to fill the paper cigarette tube, and hence is detrimental.

Another difficulty of the prior art system is that some "hang up" of falling tobacco particles on the air lock door may occur during the dumping operation, and these particles result in incomplete sealing of the air lock closure, with the consequent development of leaks and the necessity for additional vacuum.

SUMMARY OF INVENTION

The present invention provides a novel tobacco metering, opening and feeding system which enables separated tobacco particles to be conveyed at lower speeds, typically about 2600 ft/min (about 800 m/min) or lower, and hence the degradation of the tobacco is decreased, which involves the utilization of the continuous application of vacuum to the conveying pipe.

In accordance with the present invention, there is provided a continuous method of processing cut tobacco, which comprises: (a) continuously drawing air through a tobacco feed conduit extending from a first location having a reservoir of cut tobacco thereat to a second location; (b) metering cut tobacco from the reservoir into the tobacco feed conduit at the first location; (c) conveying the metered tobacco from the first location through the tobacco feed conduit to the second location; (d) separating the conveyed tobacco from the conveying air at the second location; and (e) discharging the separated tobacco from the second location through a rotary air lock.

The invention also includes apparatus for effecting this method, which comprises: (a) tobacco reservoir means at a first location and containing tobacco; (b) tobacco opening and metering means communicating the tobacco reservoir means at the first location for opening and metering tobacco therefrom; (c) tobacco conveying conduit means extending from the first location to a second location remote from the first location and positioned to receive the opened and metered tobacco from the tobacco opening and metering means and to convey the same to the second location; (d) vacuum-inducing means communicating with the tobacco conveying conduit means for drawing air through the conveying conduit means from the first location to the second location, whereby the drawn air acts as the conveying medium for the tobacco through the conveying conduit means; (e) tobacco-air separating means at the second location for separating the drawn air from the conveyed tobacco; and (f) rotary tobacco discharge means at the second location for discharging the separated tobacco from the second location.

The lower conveying velocities which are attained using continuous air flow in this invention normally cannot be used in the discontinuous prior art system referred to above since at these lower velocities, tobacco particles which remain in the conveying pipe when air flow ceases and the air-lock separator is opened are not picked up again when flow recommences and clogs develop. The higher velocities typical of the prior art system are required to pick up those particles and prevent clog formation.

Continuous air flow also is not possible in the prior art system since the air lock construction necessitates ceasing air flow for the air lock to be opened to dump accumulated tobacco therefrom. The present invention utilizes a rotary air lock which enables tobacco to be discharged without the air flow ceasing.

It is possible to utilize lower air velocities in the discontinuous discharge system if the conveying pipe is purged of tobacco prior to shut-off of the vacuum. However, such purging is time consuming, especially when long conveying distances are involved, as often is the case, and large size air lock equipment is required. In view of these difficulties, the prior art has utilized the higher air velocities, which, as noted above, leads to tobacco degradation.

DESCRIPTION OF PREFERRED EMBODIMENT

Figure 1:
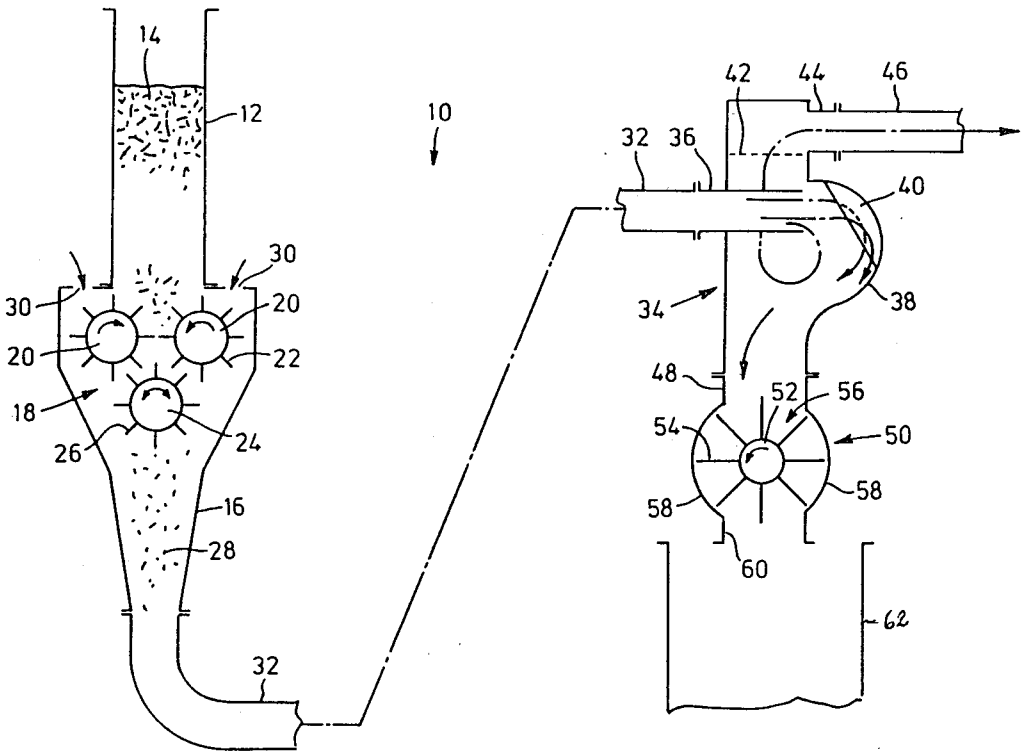
FIG. 1 is a schematic representation of one embodiment of the invention wherein the tobacco is discharged to a conventional cigarette-making machine hopper.

Referring first to FIG. 1, a tobacco metering and conveying system 10 constructed in accordance with one embodiment of the invention includes a reservoir tube 12 in which cut tobacco 14 is positioned for metering and conveying.

The reservoir 12 at its lower end communicates with a housing 16 wherein are located a set of rollers 18 arranged for rotation about parallel horizontal axes. The set of rollers 18 includes a horizontally-spaced pair of rollers 20 located immediately below the lower opening to the tube 14 to receive tobacco in the gap between the rollers 20. The left-hand side roller 20 is arranged to rotate in a clockwise direction while the right-hand side roller 20 is arranged to rotate in an anti-clockwise direction. The surfaces of the rollers 20 include a plurality of radial projections 22 which cooperate in the gap between the rollers 20 to meter the desired quantity of tobacco from the tube 14. The quantity of tobacco metered by the rollers 20 may be varied by varying the speed of rotation of the rollers.

The set of rollers 18 also includes a third roller 24 located below and equidistantly from the rollers 20. The third roller 24 may be rotated in either direction and includes a plurality of radial projections 26 which open the tobacco metered through the gap between the rollers 22 to form a plurality of individual separated tobacco particles 28 falling in the housing 16 below the roller 24.

A set of rollers suitable for use as the set of rollers 18 is described and illustrated in detail in U.S. Pat. No. 4,135,615, assigned to the assignee of this application, the disclosure of which is incorporated herein by reference.

Openings 30 are in the wall of the housing 16 to permit air to be drawn into the housing 16 as described in more detail below. The housing 16 communicates at its lower end with one end of a tobacco conveying pipe 32 which extends therefrom to an air-tobacco separating device 34.

The air-tobacco separating device 34 includes a horizontal entrance pipe 36 which terminates adjacent a curved wall 38 which has a spreader device 40 projecting from the surface thereof to spread the circular spray of tobacco particles entering the separator 34 into a falling curtain following the wall 38.

An air-permeable and tobacco-impermeable screen 42 is located above the entrance pipe 36 and separating the interior of the separator 34 from an upper exit 44 which communicates with a source of vacuum (not shown) through pipe 46.

The lower end of the air-tobacco separating device 34 communicates with the inlet 48 of a rotary air lock 50 which has a rotor 52 with radical blades 54 which define tobacco receiving and conveying compartments 56 therebetween. The radial blades 54 project into sealing engagement with part-circular walls 58. The outlet 60 of the rotary air lock 50 is open to atmosphere and communicates with the inlet 62 of the tobacco hopper of a cigarette-making machine (not shown).

The rotary air lock 50 may be constructed as described and illustrated in copending U.S. patent application Ser. No. 003,290 filed January 15, 1979, assigned to the assignee of this application, the disclosure of which is incorporated herein by reference. The rotary air lock 50 serves to discharge tobacco particles entering the separator 34 therefrom.

The system 10 provides tobacco feed for a single cigarette-making machine. In a plant, a plurality of such systems would be provided for individually feeding a plurality of machines.

Figure 2:
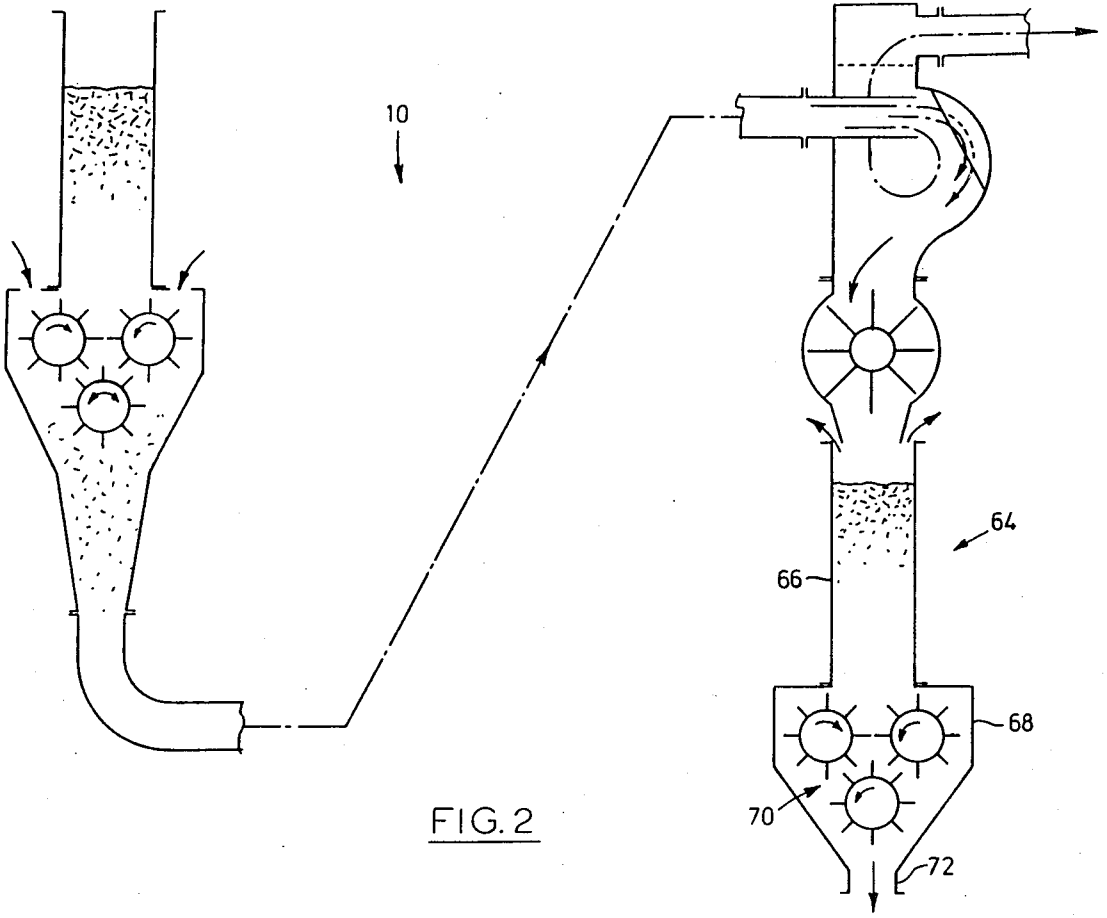
FIG. 2 is a schematic representation of the same embodiment of the invention as illustrated in FIG. 1 but wherein the tobacco is discharged to a metering tube feed for the cigarette-making machine hopper.

FIG. 2 illustrates the same tobacco metering and conveying system 10 as FIG. 1 and description thereof, therefore, will not be repeated. In place of the conventional hopper inlet 62, a metering tube 64 is used to provide feed to the cigarette maker. The metering tube 64 includes a reservoir tube 66, a lower housing 68, a set of rollers 70 and a discharge outlet 72, analogous to the reservoir tube 12, housing 16 and rollers 18 referred to above.

OPERATION

In operation, vacuum is continuously applied to the interior of the tobacco-air separator device 34 through pipe 46. Under the influence of this vacuum, air is drawn through the openings 30 to the housing 16 and through the pipe 32.

Tobacco is metered from the reservoir 12 by the pair of rollers 20 and opened by the roller 24. The quantity metered is usually in response to cigarette-making machine feed requirements. The separated individual tobacco particles are air conveyed in the air stream flowing through pipe 32 to the separator 34.

As the mixture of air and tobacco enters the separator 34, separation occurs. The air is drawn upwardly through the screen 42 and out of the separator 34 under the influence of the vacuum applied through pipe 46. The screen 42 serves to prevent tobacco particles from exiting the separator 34 with the air stream.

Under the conveying force brought about by the speed of air flow through the pipe 32, the tobacco particles project towards the curved wall 38 and, under the influence of the spreader 40 and gravity, form a curtain of tobacco particles which fall through the inlet 48 to the air lock 50 and into the compartments 56.

The tobacco in the compartments 56 is conveyed by rotation of the rotor 52 from the vacuum environment at the inlet 48 to the air lock 50 to the atmospheric pressure environment of the outlet 60 from the air lock 50. The tobacco falls out of the outlet 60 either into the cigarette-making machine hopper inlet 62 in the case of FIG. 1 or into the metering tube 64 in the case of FIG. 2.

In the tobacco metering and conveying system 10, therefore, the air flow through the pipe 32 is continuous, although the conveyance of tobacco by the air flow may be, and often is, discontinuous in character. Only the amount of tobacco required by the cigarette-making machine at any given time is metered from the reservoir 12 and opened into the flowing air stream. The tobacco is discharged from a tobacco-air separator which does not require air flow to cease to permit tobacco discharge.

The continuous air flow through the conveying pipe 32 which results from the unique combination of structural elements in the tobacco metering and conveying system 10 permits a much lower air flow rate to be utilized than has heretofore been the case. Tobacco degradation and consequent loss of filling power, therefore, are avoided.

SUMMARY OF THE DISCLOSURE

In summary of this disclosure, the present invention provides a novel tobacco metering, opening and conveying system which has considerable advantages over the prior art. Modifications are possible within the scope of the invention.

What I claim is:

1. Apparatus for conveying tobacco, which comprises:

(a) tobacco reservoir means at a first location and containing tobacco, said tobacco reservoir means comprising an upright elongate tube open at the top for receiving cut tobacco therein and open at the bottom for discharging said cut tobacco therefrom;

(b) tobacco opening and metering means communicating with said tobacco reservoir means at said first location for opening and metering tobacco therefrom, said tobacco opening and metering means including a set of roller elements arranged for rotation about parallel axes, said set of rollers including an upper pair of horizontally-spaced rollers positioned to meter tobacco received from the open bottom end of said elongate tube and a lower roller positioned equidistantly from the axes of said pair of rollers and to open tobacco metered by said pair of rollers;

(c) tobacco conveying conduit means extending from said first location to a second location remote from said first location and positioned to receive said opened and metered tobacco from said tobacco opening and metering means and to convey the same to said second location;

(d) vacuum-inducing means communicating with said tobacco conveying conduit means for drawing air through said conveying conduit means from said first location to said second location, whereby said drawn air acts as the conveying medium for said tobacco through said conveying conduit means;

(e) tobacco-air separating means at said second location for separating said drawn air from said conveyed tobacco; and (f) rotary tobacco discharge means at said second location for discharging said separated tobacco from said second location.

2. The apparatus of claim 1 wherein said set of roller elements is positioned in an enclosed housing having an upper inlet communicating with said upright elongate tube for receipt of tobacco therethrough to said pair of rollers, a lower outlet communicating with said tobacco conveying conduit means, and air inlet means for permitting air flow into said enclosed housing under the influence of said vacuum-inducing means.

3. The apparatus of claim 1 or 2 wherein said second location comprises an enclosed housing having an upper outlet communicating with said vacuum-inducing means, an inlet communicating said tobacco-conveying conduit means and located below said upper outlet and separated therefrom by air-permeable and tobacco-impermeable screen means, and a lower outlet communicating with an upper inlet of said rotary tobacco discharge means.

4. The apparatus of claim 3 wherein said inlet extends horizontally into said enclosed housing towards a curved wall, said curved wall having tobacco spreading means projecting therefrom towards said inlet for forming a curtain of falling tobacco particles on said curved wall from tobacco particles entering said enclosed housing.

5. The apparatus of claim 4 wherein said rotary tobacco discharge means comprises a bladed rotor mounted for rotation between curved side walls which sealingly engage the blades of said rotor, the blades defining tobacco-receiving and-conveying compartments therebetween, an upper inlet for receiving tobacco from the lower outlet of said enclosed housing and a lower outlet for discharge of tobacco conveyed by said rotor from said inlet by said tobacco-receiving and-conveying compartments.

6. The apparatus of claim 1 or 2 wherein each of said rollers has radially-extending projections.

* * * * *